US009138888B1

(12) United States Patent
Worden et al.

(10) Patent No.: US 9,138,888 B1
(45) Date of Patent: Sep. 22, 2015

(54) HANDLE ACCESSORY

(71) Applicant: Preddis LLC, San Antonio, TX (US)

(72) Inventors: Michael Worden, San Antonio, TX (US); Nathaniel Hallee, Minneapolis, MN (US)

( * ) Notice: Subject to any disclaimer, the term of this patent is extended or adjusted under 35 U.S.C. 154(b) by 0 days.

(21) Appl. No.: 14/489,202

(22) Filed: Sep. 17, 2014

(51) Int. Cl.

| | |
|---|---|
| ***A45C 13/26*** | (2006.01) |
| ***B25G 3/38*** | (2006.01) |
| ***B65D 25/28*** | (2006.01) |
| ***B65D 25/32*** | (2006.01) |

(52) U.S. Cl.
CPC ..... *B25G 3/38* (2013.01); *B65D 25/2879* (2013.01); *B65D 25/32* (2013.01)

(58) Field of Classification Search
CPC ..... B65D 33/06; A45F 5/10; A45F 5/1026; A45F 5/1046; A45F 2005/1033; A45F 2005/1053; A45F 2005/1086
USPC ..... 16/406, 422, 425, 428; 24/115 R, 132 R, 24/132 WL; 294/137, 171, 158, 170, 164; 383/6, 13, 16, 29
See application file for complete search history.

(56) References Cited

U.S. PATENT DOCUMENTS

| | | | | | |
|---|---|---|---|---|---|
| 1,460,057 | A | * | 6/1923 | Eisen | 294/171 |
| 2,274,605 | A | * | 2/1942 | Hoffmeister | 16/411 |
| 2,319,147 | A | | 5/1943 | Mason | |
| 2,398,436 | A | * | 4/1946 | Mason | 220/752 |
| 3,692,218 | A | * | 9/1972 | Friedman | 294/165 |
| 3,912,140 | A | | 10/1975 | Franges | |
| 3,913,172 | A | * | 10/1975 | Richards et al. | 16/411 |
| 4,071,063 | A | * | 1/1978 | Russell | 383/7 |
| 4,112,542 | A | * | 9/1978 | Snyder | 16/411 |
| D268,815 | S | * | 5/1983 | Schwalbach | D9/434 |
| 4,885,559 | A | * | 12/1989 | Nakano | 336/92 |
| 4,902,060 | A | | 2/1990 | Nobakht | |
| 4,932,702 | A | | 6/1990 | Sweeny | |
| 4,936,619 | A | | 6/1990 | Salazar | |
| 4,982,989 | A | | 1/1991 | Sweeny | |
| 5,029,922 | A | * | 7/1991 | DiNapoli et al. | 294/27.1 |
| 5,068,949 | A | * | 12/1991 | Horace | 24/115 R |
| 5,083,825 | A | * | 1/1992 | Bystrom et al. | 294/171 |
| 5,088,667 | A | * | 2/1992 | Olson | 248/101 |
| 5,243,127 | A | * | 9/1993 | Kitagawa | 174/377 |
| 5,257,845 | A | | 11/1993 | McConnell | |
| 5,279,443 | A | | 1/1994 | Koda et al. | |
| 5,356,190 | A | * | 10/1994 | Torres | 294/171 |
| 5,368,393 | A | | 11/1994 | Normann | |
| 5,487,582 | A | * | 1/1996 | Bourgeois et al. | 294/146 |

(Continued)

FOREIGN PATENT DOCUMENTS

| | | | |
|---|---|---|---|
| BR | 8701869 | U2 * | 7/2009 |
| JP | 10215939 | A * | 8/1998 |
| JP | 2007037947 | A * | 2/2007 |

*Primary Examiner* — Chuck Mah
(74) *Attorney, Agent, or Firm* — Ahab S. Ayoub

(57) ABSTRACT

A handle accessory for reversibly connecting to a handle of a container without detaching the handle from the container, the accessory having first and second sides connected by a hinge, a passage for the placement and retention of the handle, and an enclosure for the placement of items between the two sides. The handle accessory is configured to permit access to the enclosure without removal from a handle. Also, a method for forming a handle accessory as a single unit, having at least one living hinge, a substantially sealable enclosure, and a retention mechanism for reversibly connecting to a predetermined container handle configuration.

25 Claims, 10 Drawing Sheets

(56) References Cited

U.S. PATENT DOCUMENTS

| | | | | | |
|---|---|---|---|---|---|
| D369,745 | S | * | 5/1996 | Kitazaki | D9/434 |
| 5,599,052 | A | | 2/1997 | Van Davelaar | |
| 5,695,234 | A | * | 12/1997 | Coticchio et al. | 294/152 |
| 5,738,401 | A | | 4/1998 | Fan | |
| 5,865,494 | A | | 2/1999 | Tipp | |
| 5,881,432 | A | | 3/1999 | Good | |
| D408,259 | S | | 4/1999 | Hagen | |
| 5,920,250 | A | * | 7/1999 | Watanabe et al. | 336/92 |
| 6,049,948 | A | * | 4/2000 | Leonardi | 16/428 |
| 6,135,310 | A | | 10/2000 | Svehaug | |
| D442,085 | S | | 5/2001 | Bozlee | |
| D451,389 | S | | 12/2001 | Bozlee | |
| 6,354,645 | B2 | | 3/2002 | Bozlee | |
| 6,378,925 | B1 | | 4/2002 | Greenlee | |
| 6,405,409 | B1 | | 6/2002 | Zirella | |
| 6,497,006 | B2 | | 12/2002 | Gallup | |
| 6,618,910 | B1 | * | 9/2003 | Pontaoe | 24/115 H |
| 6,749,240 | B1 | | 6/2004 | Burr et al. | |
| 6,796,002 | B2 | | 9/2004 | Beckwith | |
| 6,901,635 | B1 | * | 6/2005 | Scola | 16/422 |
| 6,994,553 | B2 | | 2/2006 | DaRif | |
| 7,005,171 | B2 | | 2/2006 | Lerner | |
| 7,024,730 | B2 | | 4/2006 | Scholes | |
| 7,039,996 | B2 | | 5/2006 | Crawley | |
| 7,232,169 | B2 | | 6/2007 | Porter | |
| 7,387,324 | B1 | | 6/2008 | Sharpe | |
| 7,805,813 | B1 | | 10/2010 | Bunyard | |
| D632,030 | S | * | 2/2011 | Lumsden | D30/141 |
| 7,980,415 | B2 | | 7/2011 | Crawley | |
| 8,413,839 | B2 | | 4/2013 | Horvath | |
| 8,516,727 | B1 | | 8/2013 | Maraia | |
| 2002/0125385 | A1 | | 9/2002 | Tweed | |
| 2002/0158483 | A1 | | 10/2002 | Greenlee | |
| 2004/0051331 | A1 | | 3/2004 | Freedlund | |
| 2004/0117947 | A1 | | 6/2004 | Greenlee | |
| 2006/0017300 | A1 | * | 1/2006 | Erickson et al. | 294/171 |
| 2006/0022475 | A1 | | 2/2006 | Caputi | |
| 2006/0022476 | A1 | | 2/2006 | Caputi | |
| 2007/0024072 | A1 | * | 2/2007 | Leon | 294/171 |
| 2007/0059442 | A1 | | 3/2007 | Sabeta | |
| 2008/0061574 | A1 | * | 3/2008 | Seki | 294/171 |
| 2014/0182085 | A1 | * | 7/2014 | Dodge | 24/132 WL |

* cited by examiner

HANDLE ACCESSORY

BACKGROUND OF INVENTION

1. Field of the Invention

The invention relates generally to a combination carrying and storage accessory for a container handle.

2. Background Art

Paints, cleansers and other chemicals are typically displayed and sold in containers having wire loop handles attached on opposite sides and near the tops thereof to enable pivoting the wire loop handles up and over the tops of the containers. Because such containers, when full, may be quite heavy, various gripping elements have been developed to protect the hands when the container is lifted by the handle.

Generally, such gripping elements serve only a single purpose, are typically not ergonomic, reusable, comfortable, nor particularly durable. Accordingly, a need exists for an improved handle accessory.

SUMMARY OF INVENTION

In one aspect, embodiments disclosed herein relate to an accessory for use with a container handle. The accessory having a plurality of panels at least one of which is moveable to permit access to, and relative isolation of, a receptacle region configured to accept information, samples, and the like. The accessory configured to reversibly retain the container handle independent of accessibility of the receptacle region. The accessory may be formed of separable components that still permit the separate retention of a container handle, and accessibility of the receptacle region.

In one aspect, embodiments disclosed herein relate to the manufacture and use of an accessory for a container handle. Certain embodiments may be formed as a unitary device wherein the separate sides or panels, and any retention mechanism, are rotatably connected by one or more living hinges.

Other aspects and advantages of the invention will be apparent from the following description and the appended claims.

DETAILED DESCRIPTION

Figure 1A:
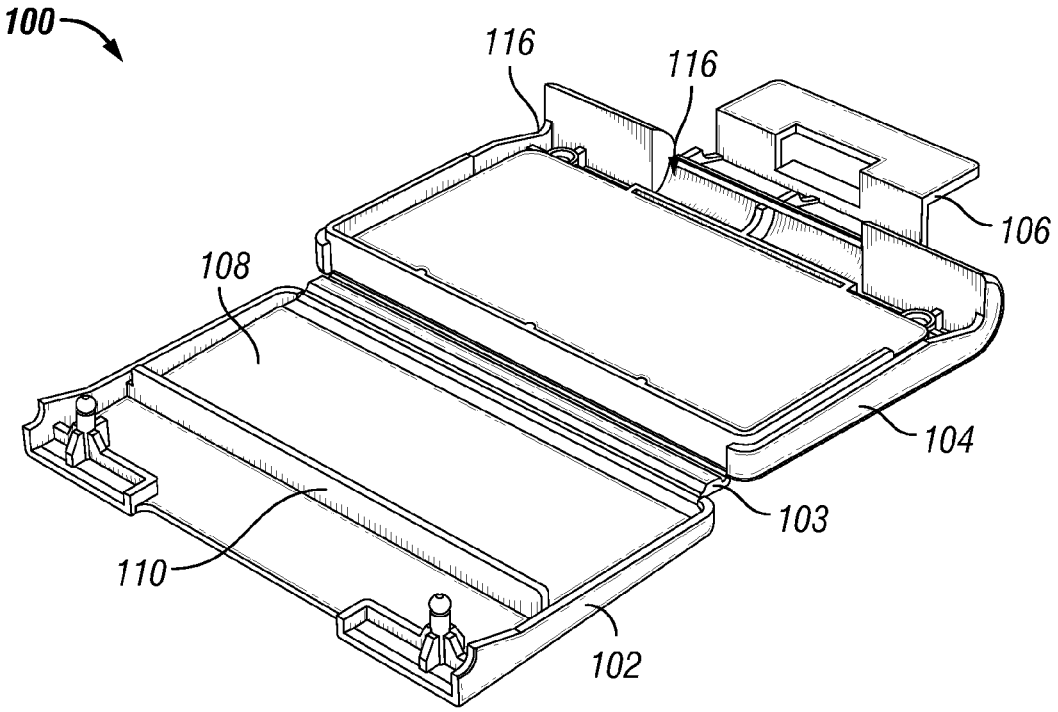
FIGS. 1A-1B show an open configuration of an embodiment of the handle accessory.
Figure 1B:
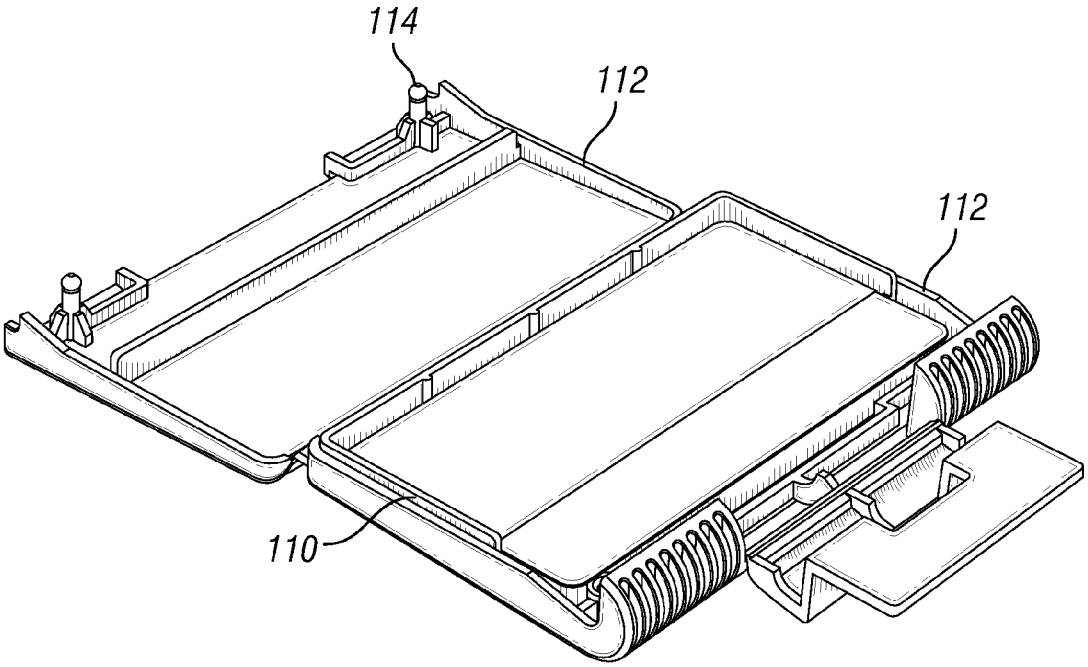

As shown in an open configuration in FIGS. 1A-1B, one embodiment of the handle accessory 100 comprises a first side 102 operatively connected to a second side 104 via a hinge 103, such as a living hinge. This operative connection permits the handle accessory 100 to be opened and closed by rotating one side relative to the other side, in the manner of a clam-shell.

A retention mechanism 106 is operatively connected to the second side 104, typically at a location distal to the location at which the first side 102 connects to the second side 104. In this embodiment, the first side 102 and retention mechanism 106 are connected along opposite edges of the second side 104. The operative connection of the retention mechanism 106 to the second side 104 may also comprise a hinge 103, such as a living hinge.

Disposed on an inner surface of at least one of the two sides 102, 104, is a receptacle region 108. The receptacle region 108 is at least partially bounded by a raised boundary element 110. The raised boundary element 110 may be continuous along one or more sides of the receptacle region 108, and may be continuous along all sides of the receptacle region 108. While shown as a rectangular area in this embodiment, the receptacle region 108 may be of any other shape known in the art, including elliptical and other configurations. The receptacle region 108 may span the majority of the interior of a side of the handle accessory, or may form a smaller discreet region within the interior surface. The peripheral wall (112 of FIG. 1B) of either side 102, 104 may also function as a boundary element 110 if disposed along at least a portion of the receptacle region 108.

The receptacle region 108 and boundary elements 110 advantageously provide a discreet and substantially enclosed area within the handle accessory 100, forming a generally protected area for various contents which may be placed therein. Additionally, the receptacle region 108 may be specifically formed to retain certain items having a known or anticipated dimension, such as information cards, data sheets, color swatches, etc. in a generally stable and secure location, advantageously permitting them to remain associated with a container having specific contents, while still accessible. Raised boundary elements 110 and/or peripheral walls 112 may be disposed along the perimeter of the handle accessory 100, or alternatively, where the receptacle region 108 occupies only a portion of the interior surface of a side, the raised boundary elements 110 and/or peripheral walls 112 may be disposed only around that portion occupied by the receptacle region 108.

The removability of certain embodiments of the handle accessory 100 from an associated container, without damage to either the handle accessory 100 or container handle, advantageously permits the handle accessory 100 to be used as a data storage, maintenance, and indexing system associated with the previously-attached container contents, without requiring retention of the entire container, or its labels. For example, a homeowner may wish to maintain a collection of handle accessories 100, reflecting various paints and/or other products used in the home, for future ease of reference. Alternatively, a manufacturer may maintain a similar index associated with products used in the manufacturing process, for later reference. Additionally, because of its unique reusable configuration, the handle accessory may be reused for increased carrying comfort and safety, with any container having a compatible handle, and may be desired by a consumer simply for such purposes, separate from its suitability as a storage device.

The raised boundary element 110 may also be configured to frictionally connect the two sides 102, 104 of the handle accessory 100 when the two sides 102, 104 are in a closed configuration. For example, if a raised boundary element 110 is disposed on the interior of each of the two sides at similar but slightly offset locations, the raised boundary element 110 disposed on the first side 102 interior may frictionally interact with the raised boundary element 110 disposed on the second side 104 interior such that the combination will create a frictional connection between the two sides.

Instead of, or in addition to, any frictional connection between the boundary element(s), discreet mating elements 114 may be disposed in the first side 102 and second side 104 such that the mating elements 114 will interact to maintain a closed configuration of the handle accessory 100. Such mating elements 114 may be of any type known in the art, including, but not limited to, male and female configurations, hook and loop materials, magnets, etc. In certain embodiments, frictional mating elements such as snap closures, may be utilized at locations along the periphery of one side of the handle accessory 100, to frictionally interact with other components of the handle accessory 100, thereby maintaining a closed configuration, as will be later shown and described.

A passage 116 is disposed along the interior of the second side 104, and configured to accept a handle of a container, as will be shown and described in more detail below. The passage 116 connects openings formed in the peripheral walls 112. When opened, the retention mechanism 106 permits placement of a handle within the passage 116, and then the retention mechanism 106 may be closed to retain the handle within the passage 116.

Figure 2:
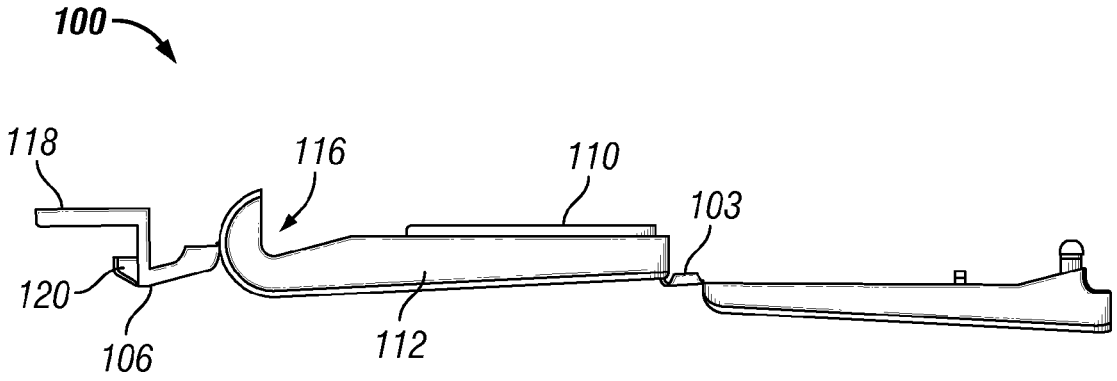
FIG. 2 shows a flat configuration of one embodiment of the handle accessory.

As shown in the embodiment of FIG. 2, the passage 116 is generally configured to form a continuous channel through the handle accessory 100. The retention mechanism 106 is shown in an open configuration for e.g., placement of a handle within the passage 116, and may be moved (typically rotated) to a closed configuration such that it will restrict removal of a handle disposed within the passage 116, as will be later shown and described. The retention mechanism 106 may include a planar region 118 and a tab 120 for purposes that will be later shown and described. The portion of the retention mechanism 106 configured to close over the passage 116, may be configured to permit some movement of a handle within that portion of the passage 116, advantageously accommodating an expected curvature of a handle, different thicknesses of various handles, and/or an expected rotation of a handle within the passage 116. This portion of the retention mechanism 106 and/or passage 116 may also be configured to accommodate prior art extruded grips within the passage 116, advantageously permitting use of the handle accessory 100 with handles having such prior art grips pre-attached. The passage 116 may be configured to accommodate such prior art grips completely within the handle accessory 100, or alternative, may be configured to operatively connect to a portion of such prior art grips such that they will extend from both openings of the passage 116, traversing the entire width of the handle accessory 100.

In the embodiment of FIG. 2, a raised boundary element 110 is disposed adjacent to a section of the peripheral wall 112 of the handle accessory 100. Such placement advantageously permits a frictional interaction between the raised boundary element 110 and an interior section of the opposing wall of the opposing side of the handle accessory 100. Raised boundary elements 110, when configured to have a greater height than a peripheral wall 112 of the side 102, 104 in which they are disposed, advantageously provide additional support for items placed in the receptacle region 108. Such items may comprise, e.g., printed data sheets, paint chips, color cards, etc.

Figure 3A:
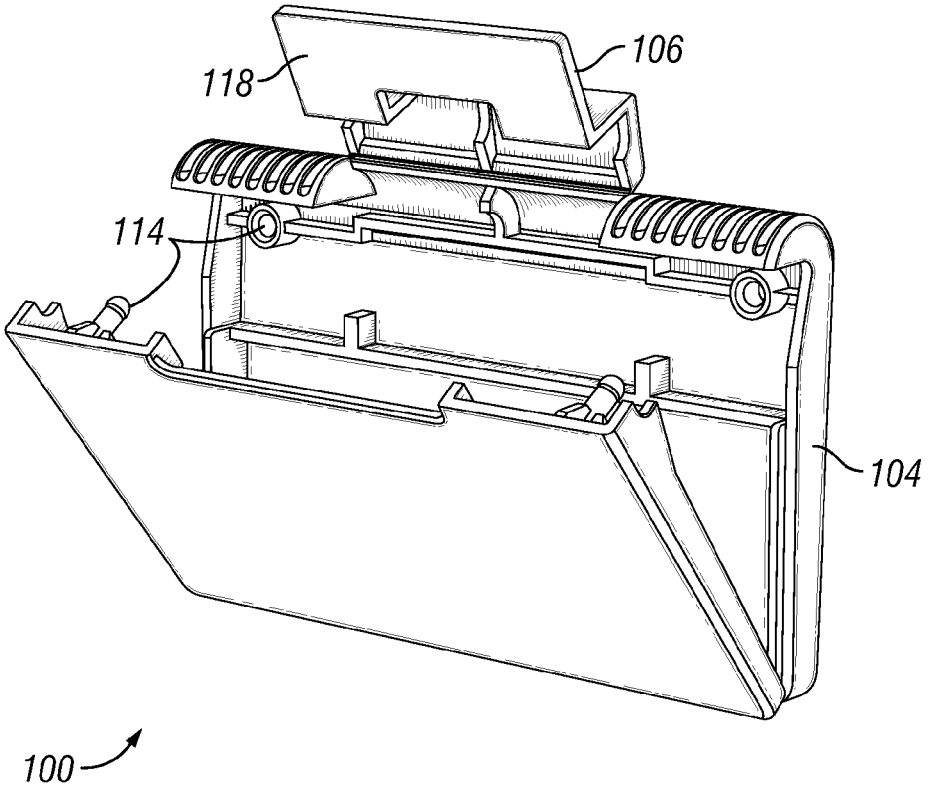
FIGS. 3A-3B open and locked configurations of a retention mechanism of an embodiment of the handle accessory.
Figure 3B:
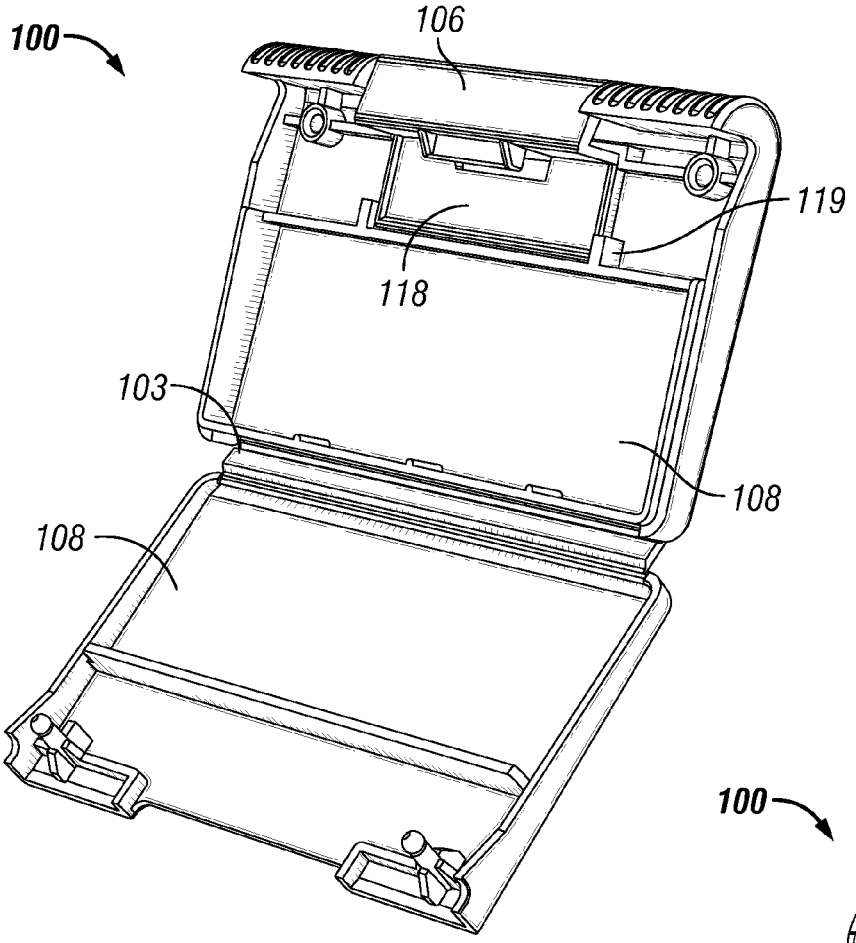

As shown in the embodiments of FIGS. 3A-3B, the interior surfaces of the handle accessory 100 may be configured to provide a relatively flat surface suitable for writing, printing, or embossing information relevant to the contents of the containers with which the handle accessory 100 may be utilized. The retention mechanism 106 is shown in an open configuration in FIG. 3A, and rotated into a closed and locked position in FIG. 3B. The configuration of the retention mechanism 106 in this embodiment includes a relatively planar section 118 configured to lay flat against the inner surface of the second side 104, to which it is operatively (rotatably) connected. The interior surface of the second side 104 includes a receiving portion with raised border sections 119 that frictionally interact with the border of the planar section 118 of the retention mechanism 106, reversibly retaining it in a closed configuration. Such a configuration advantageously provides a dual-locking system for the retention mechanism 106, permitting it to be locked over a handle disposed in the passage 116 via the frictional border sections, regardless of whether the handle accessory 100 is in an open or closed configuration. When in a closed configuration, the first side 102 of the handle accessory 100 will be disposed over the planar section 118 of the retention mechanism 106, providing a secondary means of ensuring that the retention mechanism 106 will not inadvertently open. Mating elements 114 may be utilized to retain the handle accessory 100 in the closed configuration.

Figure 4:
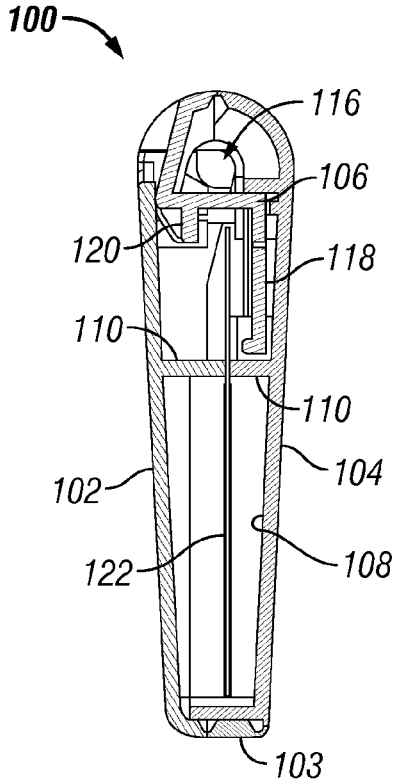
FIG. 4 shows a cross sectional view of an embodiment of the handle accessory.

In the closed configuration of one embodiment as shown in cross-section in FIG. 4, the retention mechanism 106 is in the closed position, surrounding a portion of the passage 116. Opposing raised boundary elements 110 disposed in the first and second sides 102, 104, are configured to substantially isolate the receptacle region 108. In this embodiment, the raised boundary elements 110 are configured to retain printed material 122 therebetween. Additionally, a tab 120 disposed along a surface of the retention mechanism 106 is configured to also retain such material 122 in a predetermined orientation.

Figure 5A:
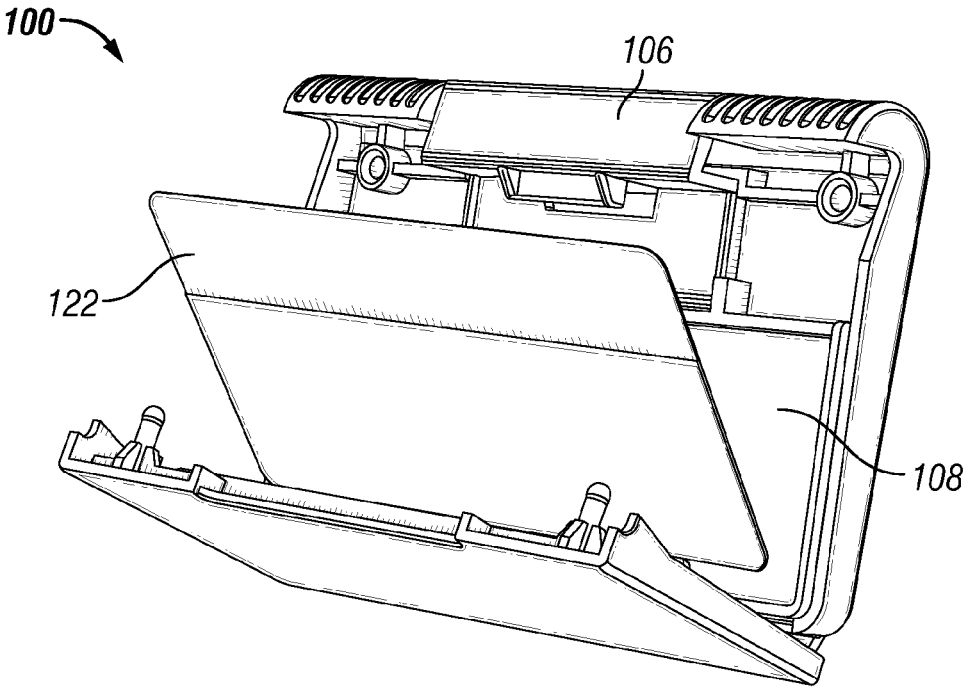
FIGS. 5A-5B show the placement of materials into an embodiment of the handle accessory.
Figure 5B:
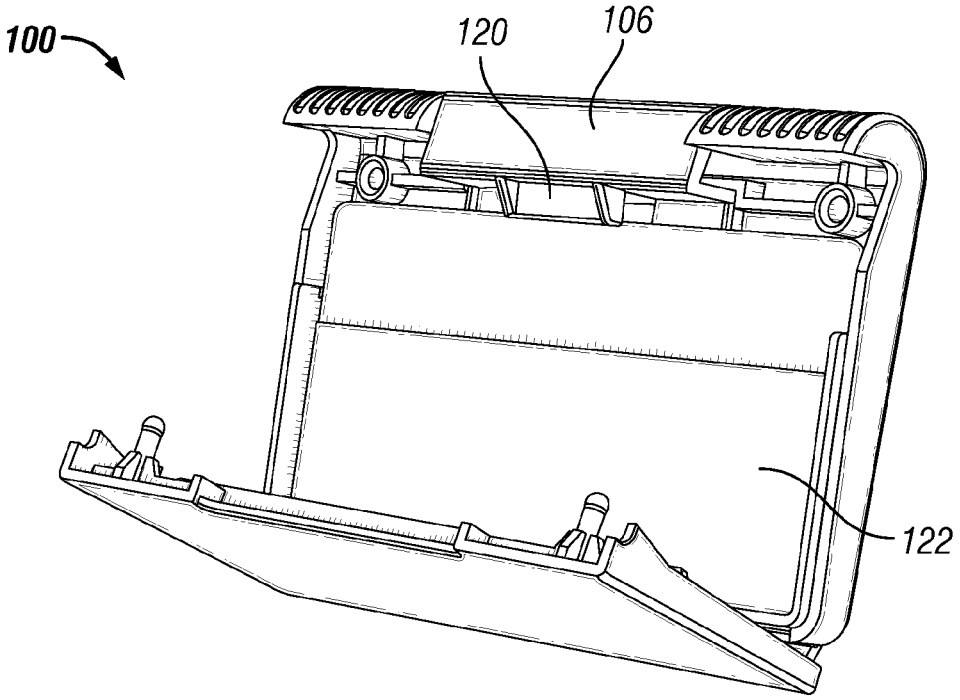

As shown in the embodiments of FIGS. 5A-5B, printed material 122 may be inserted into the handle accessory 100 and retained within the receptacle region thereof via the tab 120 of the retention mechanism 106. Such a configuration advantageously retains such material 122 in a predetermined location even when the handle accessory is in an open configuration. This permits the placement and replacement of such printed materials 122, and the addition of other items such as e.g. paint chips to match the paint in an operatively-connected container, receipts and/or other information regarding the contents of such a container. When placed beneath the printed material 122, within the receptacle region 108, such items are advantageously retained, even when the handle accessory 100 is open.

Figure 6A:
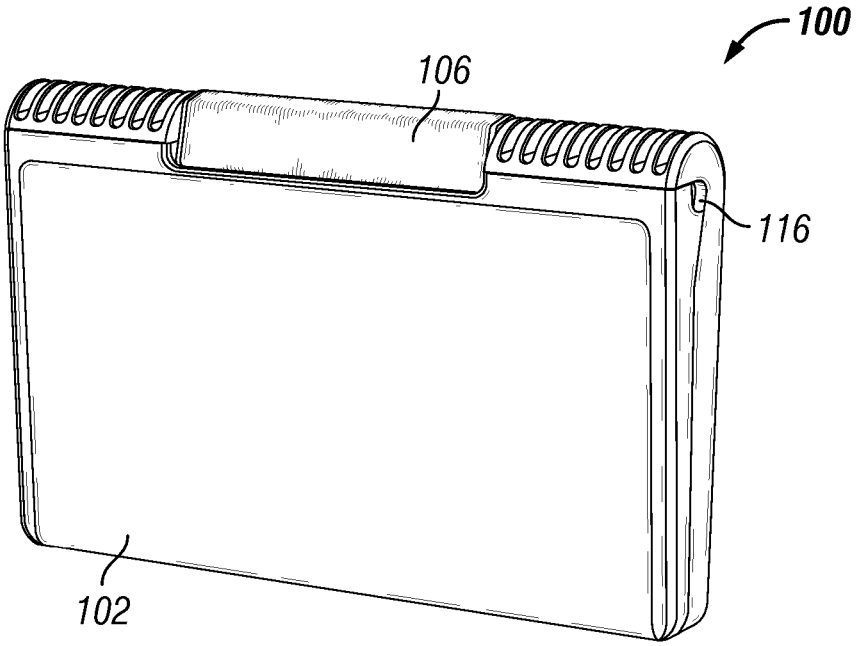
FIGS. 6A-6B are exterior views of an embodiment of the handle accessory.
Figure 6B:
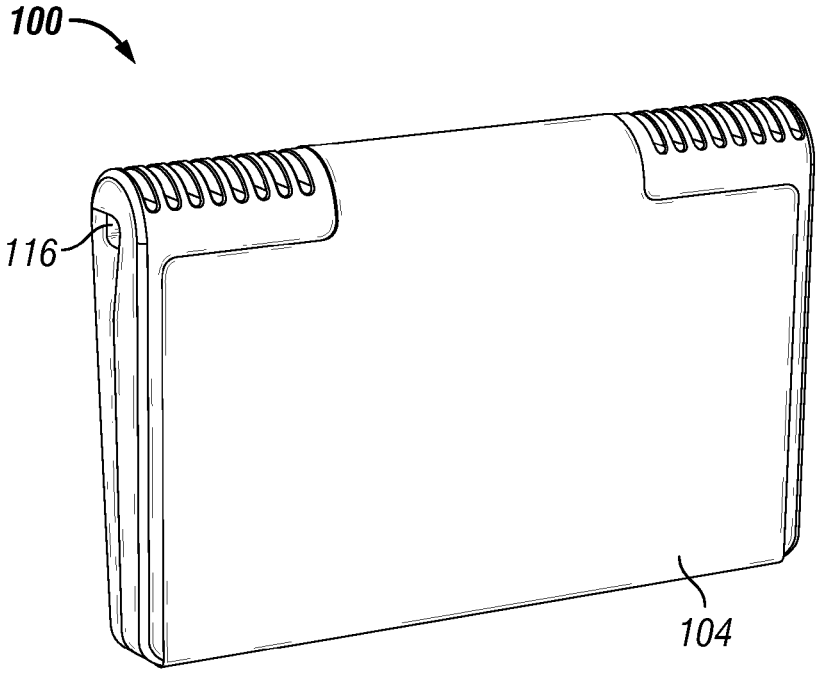

As shown in the embodiments of FIGS. 6A-6B, the surface of the handle accessory 100 along the edge that is continuous with the outer surface of the retention mechanism 106 may be configured to facilitate a secure and comfortable grip via the inclusion of ridges, textures, etc. Such variations may be included anywhere along the exterior of the handle accessory 100 for aesthetic and/or ergonomic purposes. The outer surface of the retention mechanism 106 may also include such topography, or alternatively, as shown, may have a relatively smooth surface for the placement of labels or logos. Similarly, the outer surfaces, or portions thereof, of both the first and second sides 102, 104 of the handle accessory 100 may be relatively planar, advantageously accommodating the placement of labels and/or writing. In one embodiment, and outer surface of at least one of the sides comprises a curvature selected for ergonomic stability when carrying an anticipated load.

Figure 7A:
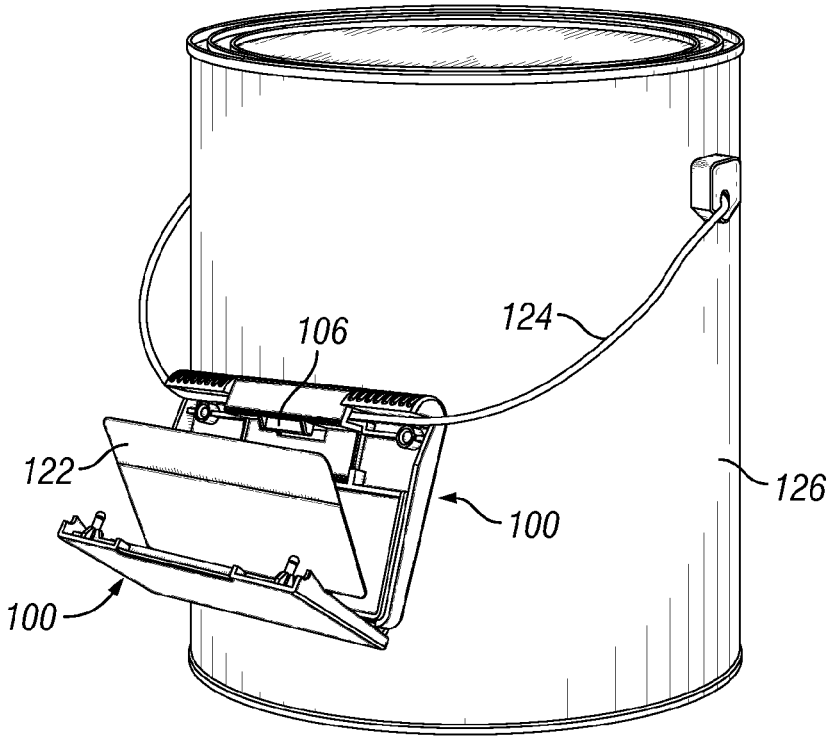
FIG. 7A-7E show embodiments of the handle accessory, in use.

As shown in the embodiments of FIGS. 7A-7E, in use, the handle accessory 100 may be operatively connected to the handle 124 of a container 126 by placing the handle 124 into the interior region of the handle accessory 100 along the passage 116. The retention mechanism 106 is then rotated into the closed position as shown in FIG. 7A, thereby locking the handle accessory 100 to the handle 124. A primary advantage of such a configuration is that it permits entry and removal of a handle 124 without requiring that one end of the handle 124 be disconnected from the container 126.

Another significant advantage of such a retention mechanism 106 configuration is that it can maintain a secure connection with a handle 124 of a container 126 even when the handle accessory 100 is in an open configuration. Printed material 122 and/or other items may be inserted into and/or removed from the handle accessory 100 without disconnecting the handle accessory 100 from the handle 124. When closed, as shown in the embodiment of FIG. 7B, the handle accessory 100 advantageously provides a substantially sealed and isolated environment for such items and materials, while securing them to the handle 124, and also providing a more secure and comfortable grip for the user.

Figure 7B:
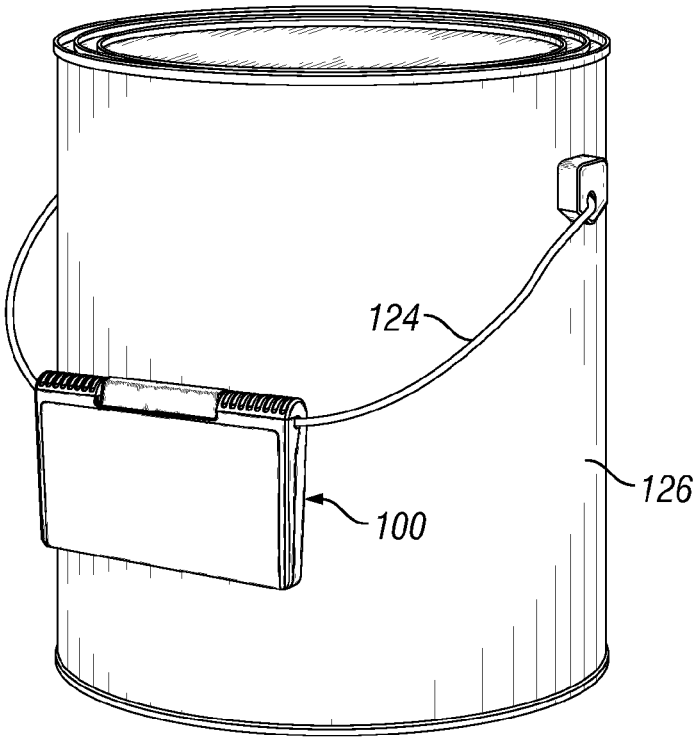
Figure 7C:
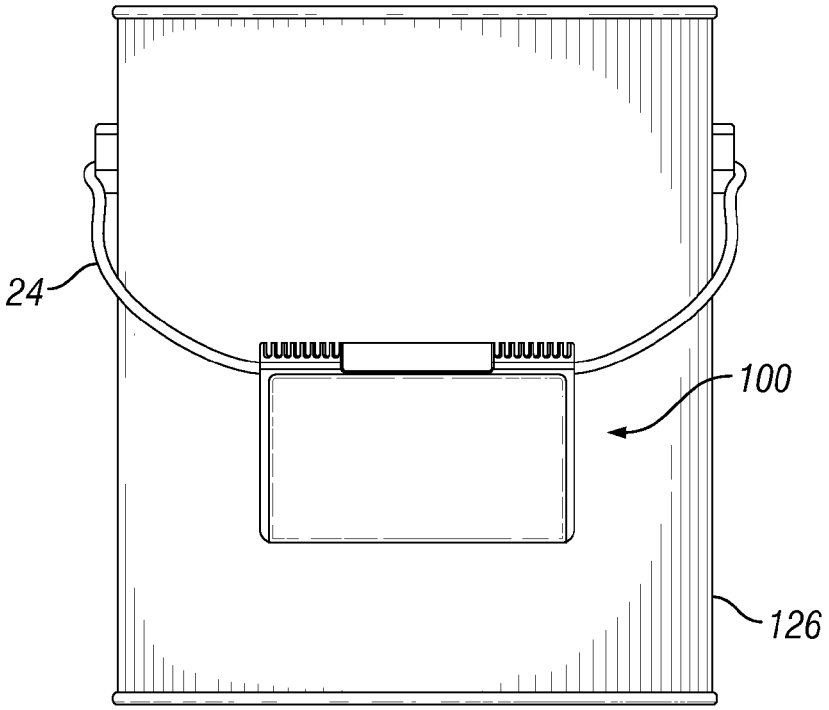

As shown in FIG. 7B-7C, embodiments may prominently display additional information on an outer surface thereof, which will be clearly visible in a retail environment, and advantageously differentiate an operatively-connected container from those of its competitors, as well as providing additional information to a consumer such as e.g., a color swatch indicating a paint color, or other information. Additionally, embodiments may be color-coded to indicate various classes of items, e.g., matte vs. glossy paints, or toxic vs. safe contents, etc.

Figure 7D:
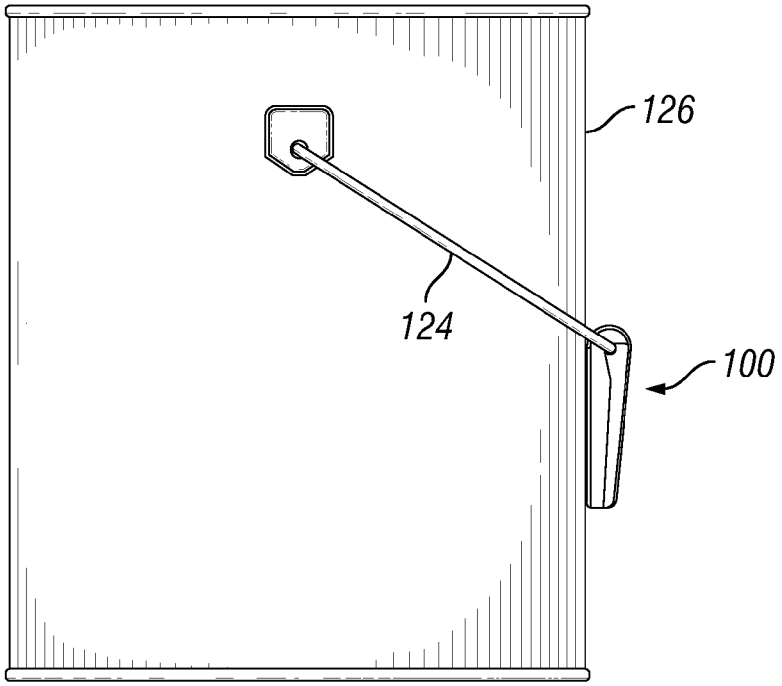
Figure 7E:
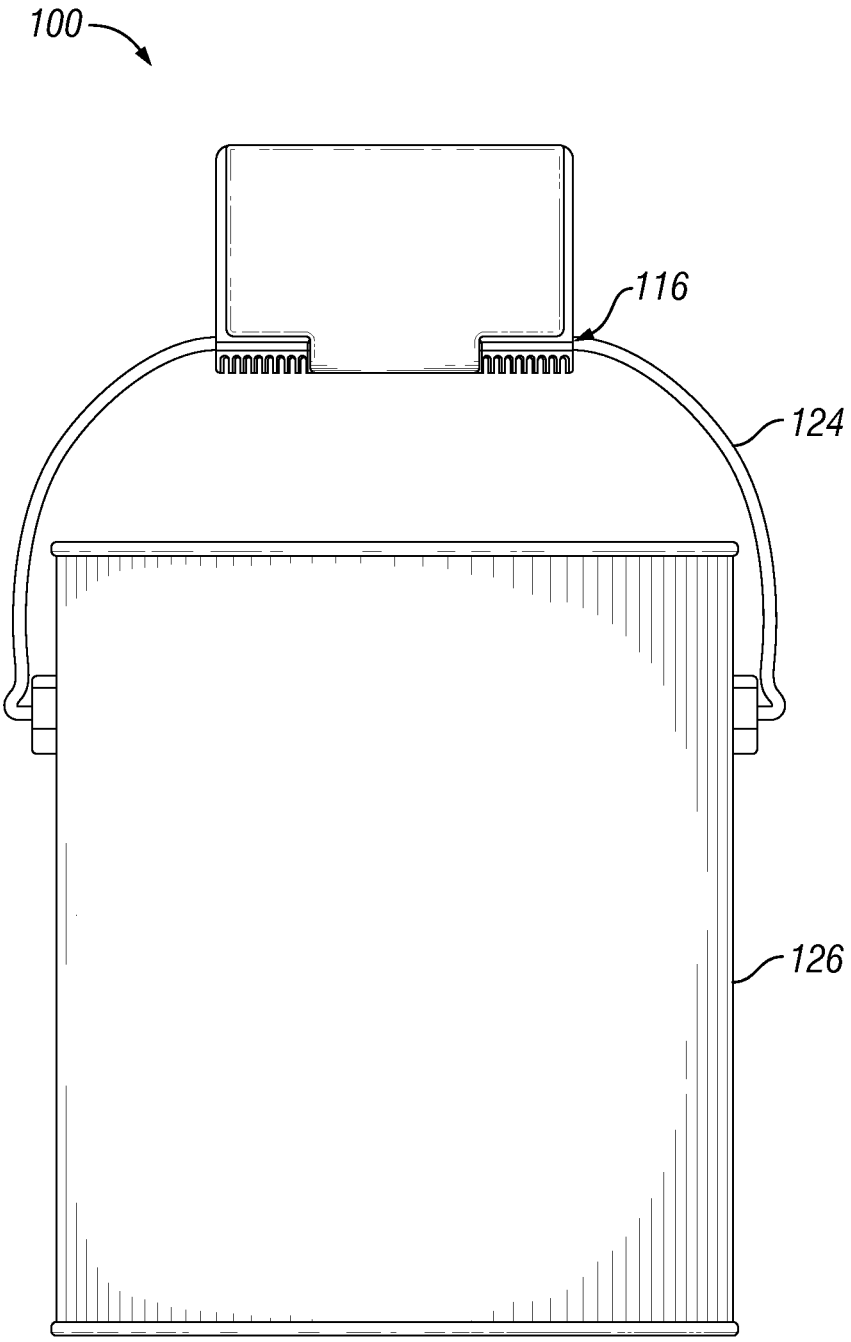

As shown in FIGS. 7C-7D, the handle accessory 100 will be suspended from the handle 124 of an operatively connected container 126 in a manner that does not add significant bulk along the sides of the container, while also providing an aesthetically pleasing location for the placement of labels and other information. Due to the unique configuration of the passage 116 as previously described, the handle accessory 100 will generally be freely rotatable around the handle 124, and as shown in FIG. 7E, may be rotated into a carrying position, wherein the gripping surface will be along the handle 124 and, combined with a relatively ergonomic overall configuration of the handle accessory 100, will provide a more secure and comfortable grip when carrying a container 126.

Figure 8:
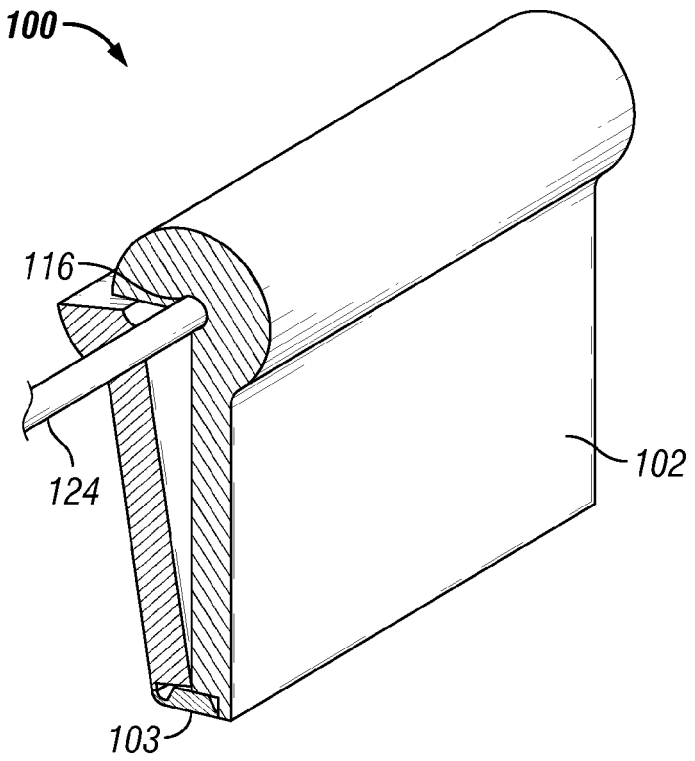
FIG. 8 shows one embodiment of the handle accessory, operatively connected to a handle.

In the single-hinge embodiment of FIG. 8, the passage 116 is formed as a molded bend at one end of the first side 102 forming a substantially-enclosed tube configured to substantially envelope a portion of an operatively-connected handle 124, and to permit entry and exit of the handle from the passage 116 while frictionally retaining the handle 124 within the passage 116 once inserted therein. The width of the opening along the length of the passage 116, relative to the diameter of a handle 124, will generally determine the resistance to entry and exit of the handle 124 from the passage 116, when the two are frictionally connected. Closure of the handle accessory 100 in such an embodiment may be maintained via snap closures (not shown) as will be described below, or via mating elements such as those previously described with respect to other embodiments.

As used herein, the term "substantially enclosed tube" will mean a passage extending to/through opposite sides of the handle accessory 100, and having a longitudinal opening disposed along a side thereof, the opening comprising less than 180 degrees of the circumference of the passage. Generally, such a substantially enclosed tube will be formed as a continuation of one side of the handle accessory 100.

Figure 9A:
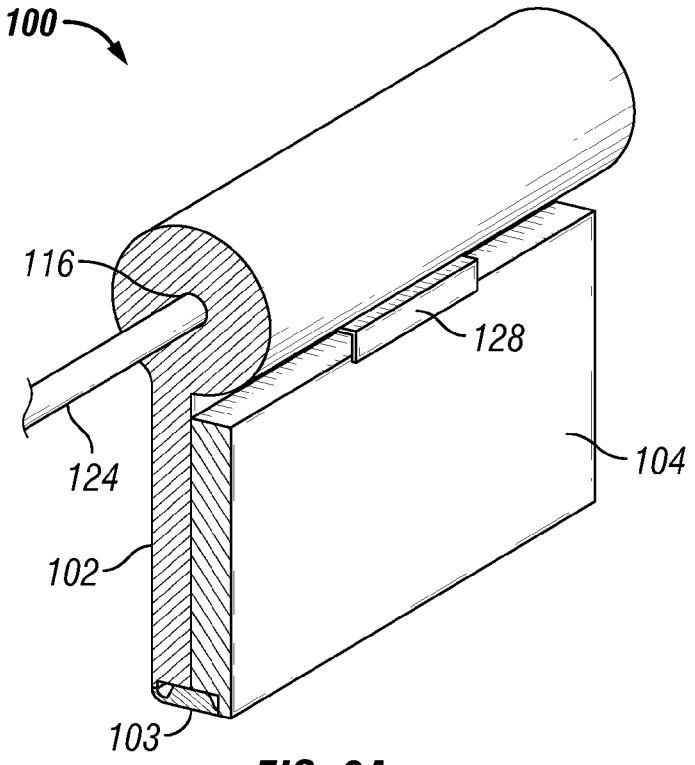
FIGS. 9A-9B show embodiments of a handle accessory having snap closures.
Figure 9B:
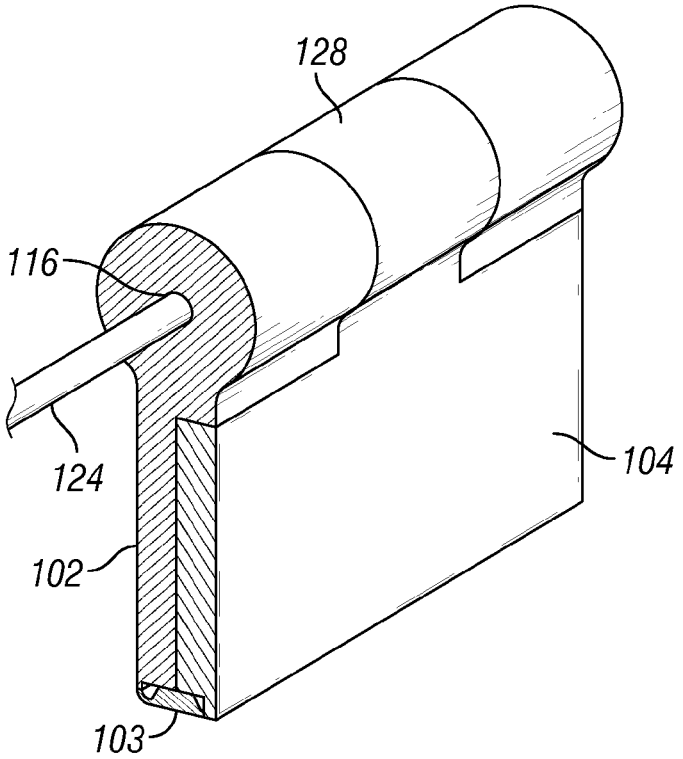

In the embodiments of FIGS. 9A-9B, snap closures 128 are disposed on a first side 102 and/or a second side 104 of the handle accessory 100, and configured to frictionally retain the handle accessory 100 in a closed configuration upon closure. In such embodiments, the passage 116 may be formed as a fully-enclosed tube along one end of the first side 102, and the hingeably-connected second side 104 may be rotated between and open and a closed configuration, wherein the snap closure 128 will frictionally retain the opposing side in a closed configuration.

Figure 10:
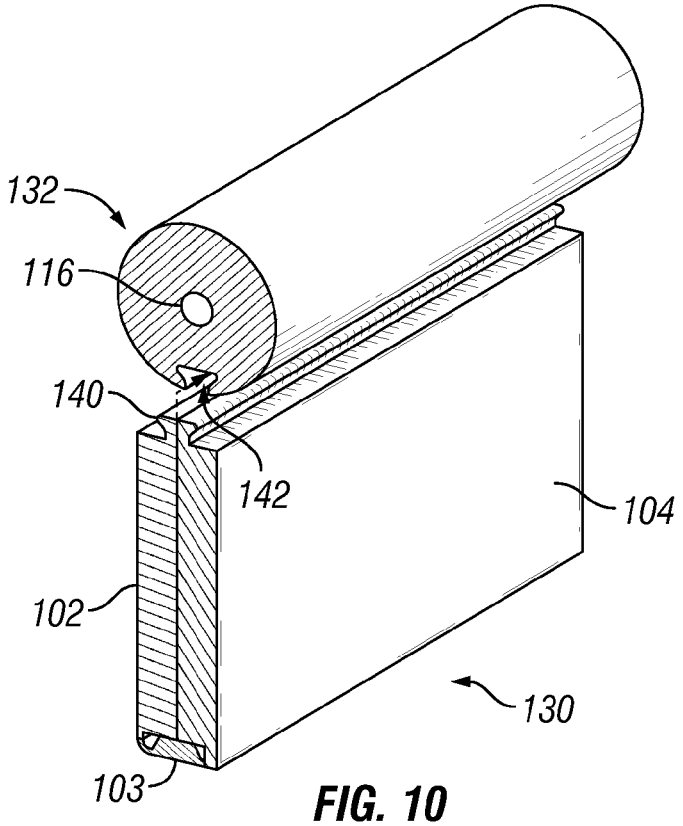
FIG. 10 shows one embodiment of a handle accessory, having separable grip and enclosure components.

FIG. 10 shows a two-piece embodiment of the handle accessory 100, having a separable receptacle component 130 and grip component 132. A receptacle region 108 (not visible in FIG. 10) of the receptacle component 130, is disposed between hingeably-connected first and second sides 102, 104 which are configured along an end opposite that of the hinge 103 to form a tapered lip 140 configured to slideably connect to a groove 142 formed in the grip component 132.

The grip component 132 includes a longitudinal passage 116 disposed therethrough. The passage 116 may be separate from the groove 142, as shown, or alternatively, the passage 116 may be open to the groove 142 such that a handle (not shown) may enter the passage 116 via the groove 142, and will be retained therein upon entry of the tapered lip 140 into the groove/passage combination, substantially sealing the passage along the side through which the groove 142 is formed. Such an "open groove" configuration advantageously permits easy connection and detachment of the handle accessory 100 and handle. In one embodiment, the groove 142 may be closed at one end such that the receptacle component 130 may only enter the groove 142 from one end.

In one embodiment, the groove 142 and/or tapered lip 140 may be configured to align the combination (when the tapered lip 140 is in the groove 142) in a desired relative relationship e.g., to encourage a desired alignment of the receptacle component 130 and grip component 132. Inclusion of such alignment elements, such as ridges in the tapered lip 140 and groove 142 combination advantageously prevents the slippage of the tapered lip 140 within the groove 142 once the two are properly aligned. One or more ridges disposed within the groove 142 may act in combination with one or more ridges disposed upon the surface of the tapered lip 140 to maintain appropriate alignment.

In the embodiment of FIG. 10, closure of the receptacle component 130 may be maintained via mating elements as previously described for other embodiments and/or by placement of the tapered lip 140 in the groove 142 of the grip component 132, when at least a portion of the tapered lip 140 is formed as an element of each side of the receptacle component 130. The embodiment of FIG. 10 advantageously permits detachment and replacement of the receptacle component 130, without requiring detachment of the grip component 132 from an operatively-connected handle.

Embodiments of the invention provide numerous advantages over prior art devices, including, but not limited to, the ability to receive and protect materials relevant to the contents of a container, such as material data safety sheets, paint chips and/or color cards, and other relevant items. Furthermore, embodiments advantageously permit both the manufacturer of the contents, and an end user, to access, supplement, and/or modify such materials, without separating the handle accessory 100 from a container 126 to which it may be connected. Embodiments may also be reversibly separable from a handle of a container without damage to the embodiment or the handle, and often without requiring any detachment of the handle from the container.

Embodiments may also advantageously be utilized to store such materials separate from a container, permitting future reference to the relevant materials once the container has been disposed of Additionally, because embodiments provide a relatively isolated and protected enclosure for the storage of such materials, the materials will be protected from common hazards experienced by traditional container labeling techniques, such as tearing or loss of exterior labels due to abrasion, and damage to such labels due to spillage of container contents.

Embodiments may comprise any materials, or combinations thereof, known in the art, including, but not limited to, plastics, metals, and elastomers. Embodiments may also comprise any color or combination thereof, and may be formed in various colors to match the contents of a container (e.g., for paints) or a category of content (e.g., color-coded to types of paints, or to indicate toxic vs. non-toxic contents, etc.). Elastomeric coatings and/or components may be utilized to e.g., increase comfort or durability.

In one embodiment, the handle accessory 100 may be formed in a single mold, such as an injection mold, and comprise at least one living hinge operatively connecting the first side to the second side. In one embodiment, a method might further include forming a second hinge within a single mold, between the second side to the retention mechanism. While hinges may be of any type known in the art, in certain embodiments, use of living hinges may have advantages including ease of manufacture and greater isolation of contents.

In one embodiment, the handle accessory 100 may include electrical components, such as speakers, lights, a display, etc. as well as a power source, such as a battery, to power such electronics. One advantage of such a configuration is that, in addition to conveying written information, it may be capable of transmitting other visual, as well as audible, information. Such configurations may be particularly advantageous in a retail setting to provide information to a potential consumer and differentiate the product from that of competitors. Such configurations may also be advantageous to consumers, and others, who may be visually-impaired, or might otherwise benefit from an alternate mode of communication. Additionally, such embodiments might be capable of providing visual and/or audio indicators based on pre-programmed criteria, such as an expiration date relating to the contents. Sensors, transmitters, and the like might also be included to advantageously provide e.g., inventory tracking, or warnings when conditions are detected that are unsuitable for the contents, such as unsafe temperatures.

The terms "comprising," "including," and "having," as used in the claims and specification herein, indicate an open group that includes other elements or features not specified. The terms "a," "an" and the singular forms of words include the plural form of the same words, and the terms mean that one or more of something is provided. The terms "at least one" and "one or more" are used interchangeably.

The term "one" or "single" shall be used to indicate that one and only one of something is intended. Similarly, other specific integer values, such as "two," are used when a specific number of things is intended. The terms "preferably," "preferred," "prefer," "optionally," "may," and similar terms are used to indicate that an item, condition or step being referred to is an optional (not required) feature of an embodiment.

As used herein, the terms "first side" and "second side" are terms of convenience used generally to assist in identifying preferred locations of other components of embodiments of the invention. While first and second sides are sometimes connected via a hinge disposed therebetween, in certain embodiments, placement of the hinge may be at any location along a side of the handle accessory, for example, one side may be significantly smaller, in one or more dimensions, relative to the other side, and may open to reveal the contents of the handle accessory. In such embodiments, the smaller of the two sides might be considered a hingeable panel configured to permit access to an enclosure within the handle accessory. While generally described with respect to traditional and living hinge configurations, hingeable connections might also be achieved by connecting two components using a flexible material that provides a similar rotatable connection between the two components, for example, by utilizing a separate plastic film or other material to connect two components in a similar manner.

The terms "inner" and "outer" with respect to a surface generally refer to the location of that surface in a closed configuration of an embodiment. While embodiments are frequently shown and described as having smooth and generally continuous outer surfaces, the outer surfaces may also be multi-faceted. For example, those portions of embodiments encompassing the passage may be generally cylindrical in cross-section, or octagonal, or otherwise, based on ergonomic and aesthetic preferences.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed is:

1. A handle accessory, comprising:

a first side hingeably connected to a second side, wherein at least one of the sides comprises a receptacle region disposed on an inner surface thereof, the receptacle region at least partially bounded by a raised boundary element;

a passage configured to receive at least a portion of a predetermined handle; and a retention mechanism for retaining the at least a portion of the handle within the passage.

2. The handle accessory of claim 1, further comprising a gripping surface along an outer surface of the handle accessory, proximal the passage, the gripping surface comprising at least one selected from ridges, textures, coatings, dimples, and bumps.

3. The handle accessory of claim 1, wherein the hingeable connection comprises a living hinge.

4. The handle accessory of claim 1, wherein the retention mechanism is hingeably connected to one selected from the first and second sides, at a location distal to and substantially parallel to, the hingeable connection between the first and second sides.

5. The handle accessory of claim 4, wherein the retention mechanism comprises a planar section.

6. The handle accessory of claim 4, wherein the retention mechanism comprises a tab.

7. The handle accessory of claim 1, wherein the first and second sides, and the retention mechanism, comprise a single molded unit.

8. The handle accessory of claim 1, further comprising mating elements disposed on inner surfaces of the first and second sides.

9. A handle accessory, comprising:

a first side hingeably connected to a second side, wherein at least one of the sides comprises a receptacle region disposed on an inner surface thereof, the receptacle region at least partially bounded by a raised boundary element; and a substantially enclosed tube configured to receive at least a portion of a handle, wherein the substantially enclosed tube comprises a continuation of the first side opposite that periphery along which the first side and the second side are hingeably connected.

10. The handle accessory of claim 9, wherein the substantially enclosed tube is configured to accept and frictionally retain the at least a portion of the handle.

11. The handle accessory of claim 10, wherein the substantially enclosed tube is flexible and comprises an opening having a width no greater than that of a predetermined handle diameter.

12. The handle accessory of claim 9, further comprising a snap closure configured to reversibly retain the first side and the second side in a closed configuration.

13. The handle accessory of claim 12, wherein the snap closure is formed as an extension of the second side, configured to partially encircle and frictionally an outer surface of the first side, proximal the substantially enclosed tube.

14. The handle accessory of claim 9, further comprising mating elements disposed on inner surfaces of the first and second sides.

15. A handle accessory, comprising:

an elongated grip component comprising first and second ends, the elongated grip component having a longitudinal passage extending therethrough, and a longitudinal tapered groove disposed in an outer surface thereof, the groove extending through at least one of the first and second ends of the gripping element; and a receptacle component comprising a first side hingeably connected to a second side along proximal edges of each side, wherein:

an opposite edge of at least one side is configured to form at least a portion of a tapered lip configured to reversibly connect to the longitudinal groove of the gripping element; and at least one of the sides comprises a receptacle region disposed on an inner surface thereof, the receptacle region at least partially bounded by a raised boundary element.

16. The handle accessory of claim 15, wherein the tapered lip is formed as an extension of both sides of the receptacle component, such that when connected in the groove, the receptacle components will be retained in a closed configuration.

17. The handle accessory of claim 15, wherein the groove extends through both ends of the grip component, the groove and the passage are in communication with one another, and formed such that a handle may enter the passage via the groove and be retained therein upon placement of the tapered lip within the groove.

18. The handle accessory of claim 15, wherein the groove extends through both ends of the grip component, the groove and the passage are in communication with one another, and the groove has a maximum width less than that of a predetermined handle, the handle accessory configured to flexibly permit entry of the handle into the groove.

19. The handle accessory of claim 15, further comprising mating elements disposed on the inner surfaces of the first and second sides of the receptacle component.

20. The handle accessory of claim 15, further comprising ridges disposed upon a surface of at least one selected from an interior surface of the groove, and an exterior surface of the tapered lip, the ridges placed in a manner that retains a desired alignment of the grip component and the receptacle component, when the two are in a joined configuration.

21. A kit, comprising:

a container;

a handle operatively connected at two ends to the container; and a handle accessory, operatively connected to the handle and rotatable thereabout, the handle accessory comprising: (a) a passage therethrough, configured to retain the handle, (b) first and second sides rotatably connected to one another, and (c) a substantially enclosed receptacle region, disposed between the first and second sides and wherein said handle accessory further comprises a rotatable retention element configured to rotatably and reversibly lock the handle within the passage.

22. The kit of claim 21, wherein the handle accessory comprises a grip component and a separable receptacle component, the grip component comprising the passage, and the receptacle component comprising the first and second sides and the receptacle region, the grip component and receptacle component each configured to reversibly connect the other.

23. A method of using a handle accessory, comprising:

placing at least one item in a receptacle region of the handle accessory, the at least one item comprising at least one selected from instructions, information, and a sample;

closing two hingeably-connected sides of the handle accessory, thereby substantially isolating the receptacle region from an external environment; and positioning a handle of a container within a passage of the handle accessory such that it is reversibly retained therein.

24. The method of claim 23, wherein the positioning further comprises the step of rotating a retention mechanism of the handle accessory from a first position to second position, wherein the second position prevents removal of the handle from the passage.

25. The method of claim 24, further comprising the step of opening the two hingeably-connected sides to access the receptacle region, while maintaining the second position of the retention mechanism.

* * * * *